US006328017B1

(12) United States Patent
Heinz et al.

(10) Patent No.: US 6,328,017 B1
(45) Date of Patent: Dec. 11, 2001

(54) FUEL INJECTION VALVE

(75) Inventors: Rudolf Heinz, Renningen; Friedrich Boecking, Stuttgart, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/308,757

(22) PCT Filed: Mar. 14, 1998

(86) PCT No.: PCT/DE98/00766

§ 371 Date: Jul. 2, 1999

§ 102(e) Date: Jul. 2, 1999

(87) PCT Pub. No.: WO99/15778

PCT Pub. Date: Apr. 1, 1999

(30) Foreign Application Priority Data

Sep. 25, 1997 (DE) ..... 197 42 320

(51) Int. Cl.[7] ..... F02M 37/04
(52) U.S. Cl. ..... 123/467; 123/506; 123/198 D
(58) Field of Search ..... 123/467, 500, 123/501, 446, 506, 198 D

(56) References Cited

U.S. PATENT DOCUMENTS 4,249,497 2/1981 Eheim et al. ..... 123/446
5,862,793 * 1/1999 Jay et al. ..... 123/467
5,893,350 * 4/1999 Timms ..... 123/467
5,915,361 * 6/1999 Heinz et al. ..... 123/467
5,941,215 * 8/1999 Augustin ..... 123/467
5,979,410 * 11/1999 Grieshaber ..... 123/467

FOREIGN PATENT DOCUMENTS

2759187 * 7/1979 (DE) ..... 123/467
1320057 * 6/1973 (GB) ..... 123/467

* cited by examiner

*Primary Examiner*—Carl S. Miller
(74) *Attorney, Agent, or Firm*—Ronald E. Greigg

(57) ABSTRACT

A fuel injection valve for an internal combustion engines is proposed, in which the control of the fuel injection valve member is controlled through the control of the pressure of a control chamber (25). This chamber is either relieved by means of a control valve (31) or is subjected to a high pressure, which brings the fuel injection valve member into the closed position. At the same time as the relief of the control chamber, a valve member (33) of a safety valve (32) that controls the fuel supply to the fuel injection valve is opened so that upon opening of the fuel injection valve, high-pressure fuel simultaneously also can travel by way of a pressure line (12) from a high-pressure fuel reservoir (14) to the injection openings (8) of the fuel injection valve (1). After the end of the injection, the valve member (33) is closed again, together with the closing of the fuel injection valve member (5). Consequently, in the event of a malfunction, unwanted fuel is prevented from reaching injection for a long period of time and consequently possibly destroying the associated engine due to overdosing.

26 Claims, 6 Drawing Sheets

FUEL INJECTION VALVE

PRIOR ART

Figure 1:
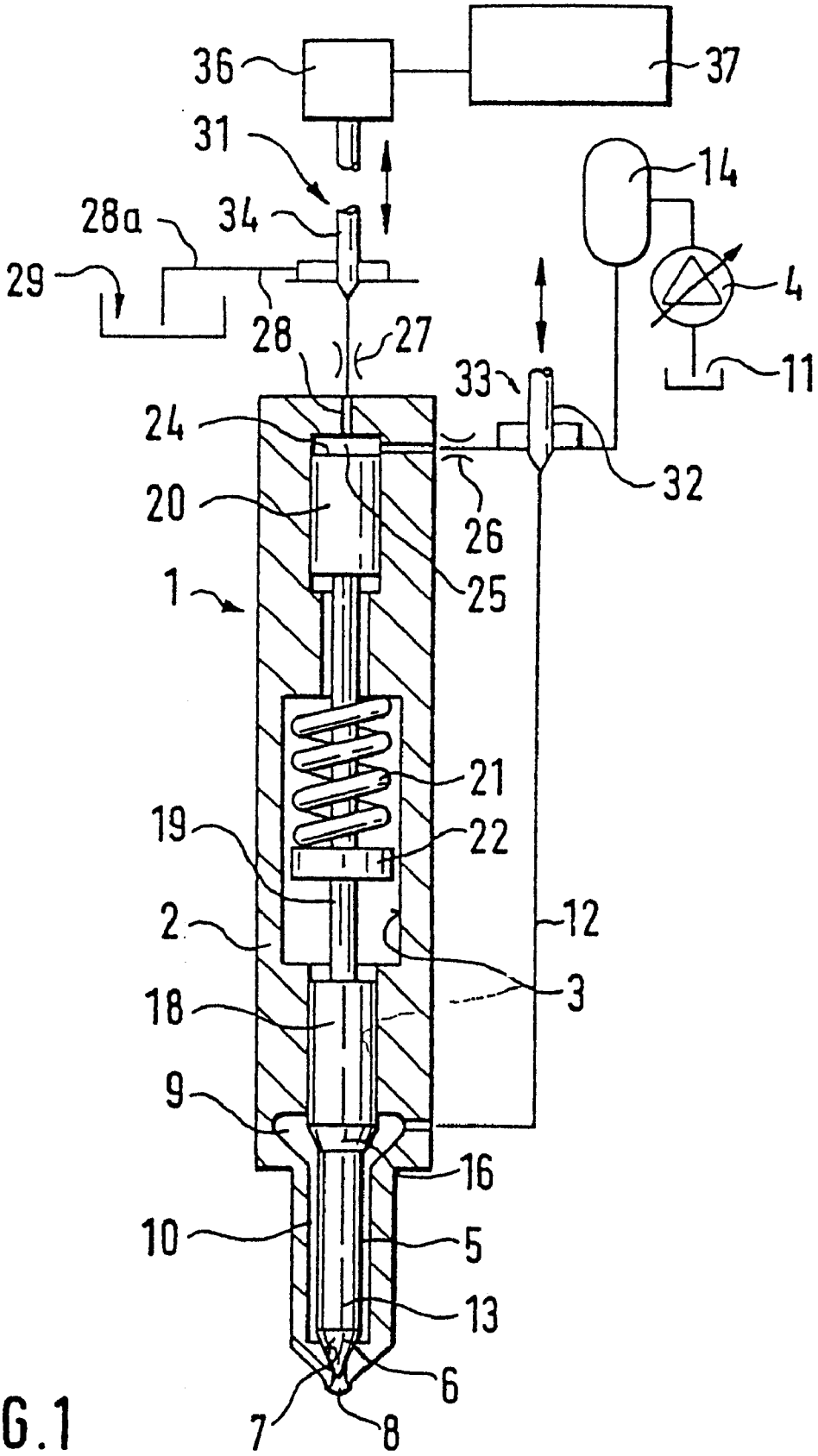

The invention is based on a fuel injection valve according to the preamble to claim 1. With a fuel injection valve of this kind, which is known from GB 1 320 057, only the relief of the control chamber is controlled by the control valve. The pressure chamber continuously communicates with the high-pressure fuel reservoir. With a fuel injection valve of this kind, there is the danger that with the occurrence of a malfunction, e.g. in the pressure control of the pressure chamber, a long-lasting injection of fuel by way of the fuel injection valve takes place, which would result in a destruction of the associated internal combustion engine.

ADVANTAGES OF THE INVENTION

The fuel injection valve according to the invention, with the characterizing features of claim 1 has the advantage over the prior art that a safety valve is provided, which is controlled synchronously to the control of the pressure in the control chamber and synchronously to the desired injection in such a way that there is a communication between the high-pressure fuel chamber and the pressure chamber only at the times of the actual injection to be produced. If the control of the control chamber fail due to a non-functioning control valve, or if a malfunction occurs in the fuel injection valve itself, then the duration of the supply with high-pressure fuel can be limited in this manner, wherein the safety valve does not have to be controlled with the same precision as the control valve for controlling the pressure in the control chamber, and the open state of the safety valve can also extend over the mutual time period of the pre-injection and the main injection.

According to claims 2 and 3, the control valve can be embodied either as a 3/2-way valve or as a 2/2-way valve. According to claims 4 and 5, the control valve and the safety valve are jointly actuated in an advantageous manner by means of a single actuation mechanism. According to claim 4, the safety valve can be electrically controlled or according to claim 5, it can be actuated jointly with the control valve, which reduces the structural cost of control elements. A separate control according to claim 4 produces the possibility of separately controlling both valves in the switching rhythm.

The use of a hydraulic pressure intensifier for transferring the actuation force according to claim 6 produces the additional possibility of path transmission, which sharply reduces the actuator stroke.

Another variant of the hydraulic pressure intensifier can be achieved by means of claim 7, since in this case, the rigidity of the transmission is minimized. Alternative to the mechanical bridge, a hydraulic distributor strip with pressure intensification can also be selected, which sharply reduces the structural cost according to claim 8, particularly since the mechanical bridge is very large.

According to claim 6, a hydraulic pressure intensifier is advantageously used or, according to claim 7, a mechanical bridge is advantageously used which hydraulically transmits an actuation force to the control valve and the safety valve. According to claim 8, the hydraulic boom can be disposed between the actuation mechanism and the valve members of the control valve and the safety valve. The valve springs of these two valves can be embodied either as open when the actuation mechanism is triggered, or, in an alternative to this, as closed when it is triggered. According to claim 11, a very advantageous embodiment is comprised in that the safety valve is controlled as a function of the pressure in the control chamber. This permits a cost savings in the actuation of the two valves, the control valve and the safety valve. According to claim 19, a further advantageous improvement of the invention is comprised in that the valve member controls two valve seats with its valve body, wherein with the passage of the valve body from one valve seat to the other, a momentary relief of the control chamber occurs, which results in a very short injection. In a further embodiment according to claim 20, the safety valve can be embodied as a 3/2-way valve and in its one position, can produce the communication between the high-pressure fuel reservoir and the control chamber, which with interrupted relief of the control chamber by means of the control valve, signifies a closing of the fuel injection valve member and at the same time, prevents the communication between the high-pressure fuel reservoir and the pressure chamber of the fuel injection valve. In its other position, this latter communication is produced and the communication to the control chamber is interrupted, which produces a rapid opening of the fuel injection valve member with the corresponding control by means of the control valve. In an advantageous embodiment according to claim 21, a piezoelectric actuation device is provided as an actuation mechanism. By means of such an actuation device, in particular very rapid switching sequences can be produced, with an extremely precise metering of the fuel injection quantity and fuel injection time. This is particularly also true in connection with claim 19 in whose embodiment a short intermediary relief of the control chamber can be achieved in order to produce a short injection. This injection is used the pre-injection before a subsequent main injection and viewed in and of itself, is a known measure for reducing combustion noise in internal combustion engines.

DRAWINGS

Nine exemplary embodiments of the invention are reproduced in the drawings and will be explained in more detail below.

Figure 2:
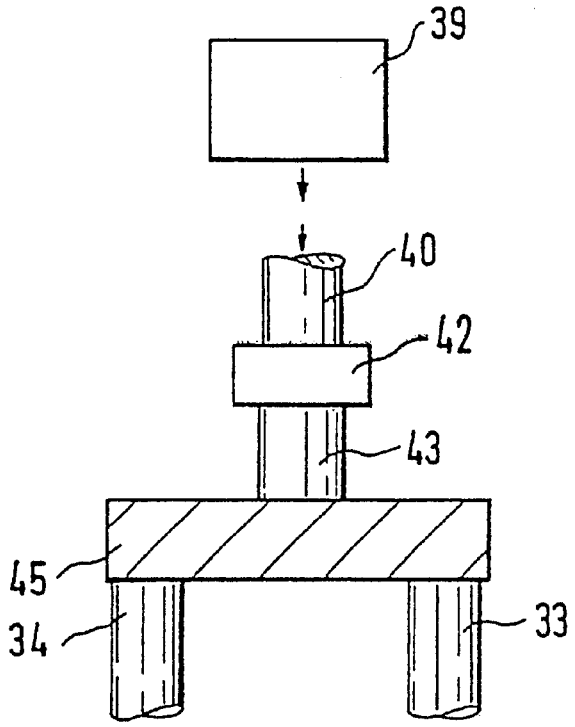

FIG. 1 shows a first exemplary embodiment in conjunction with a schematically depicted fuel injection valve, FIG. 2 is a detailed representation of the control of the control valve and the safety valve according to FIG. 1

Figure 3:
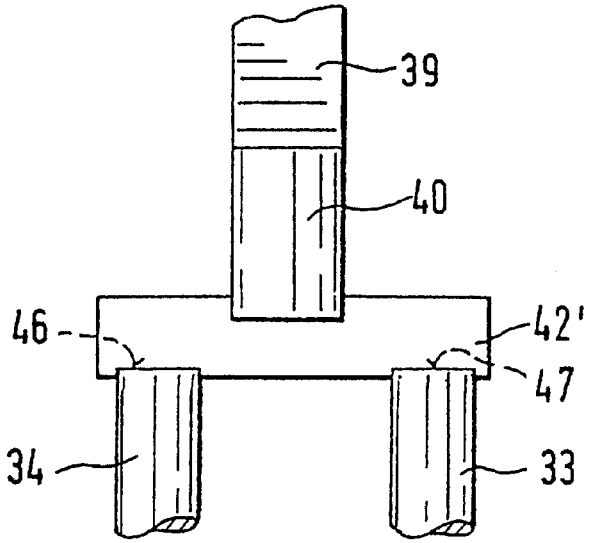
Figure 4:
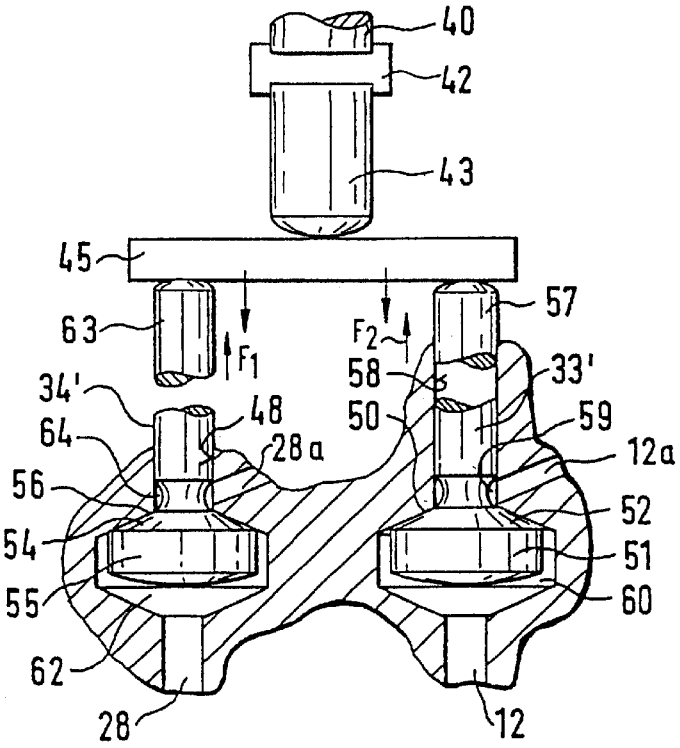
Figure 5:
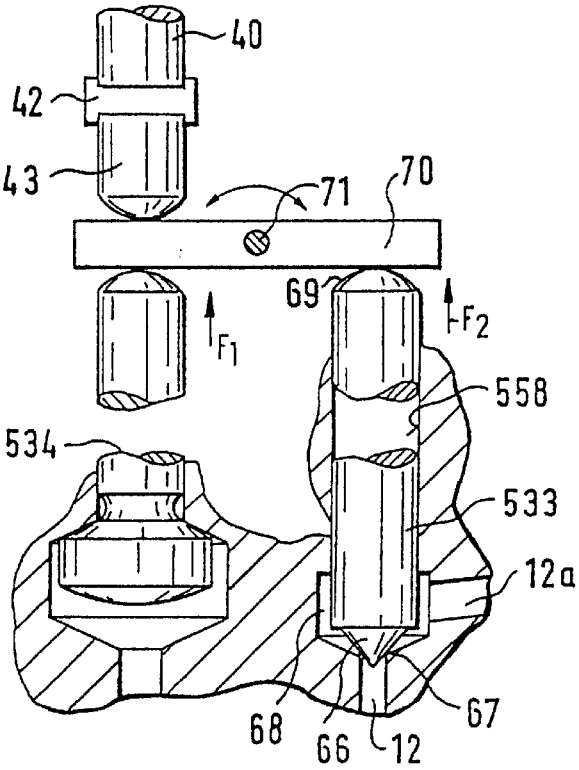
Figure 6:
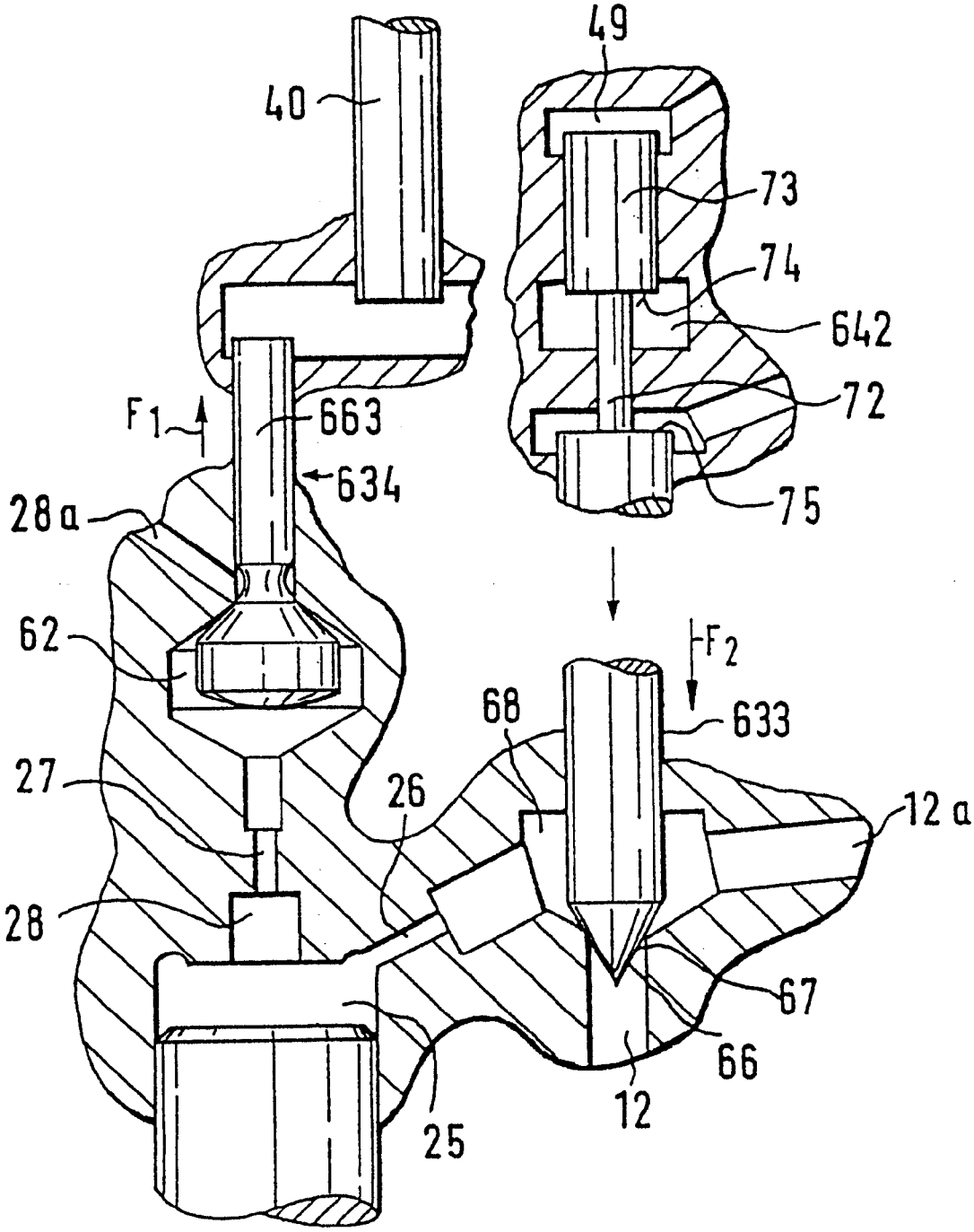
Figure 7:
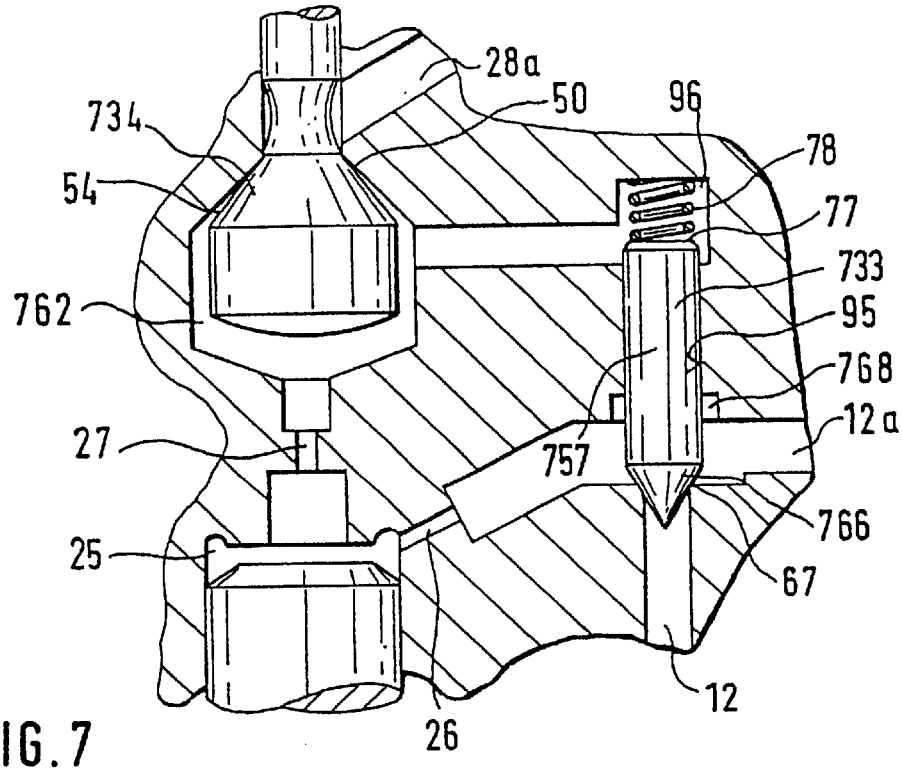
Figure 8:
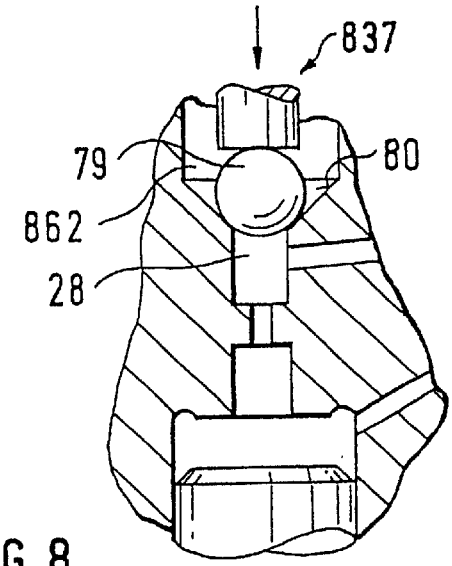
Figure 9:
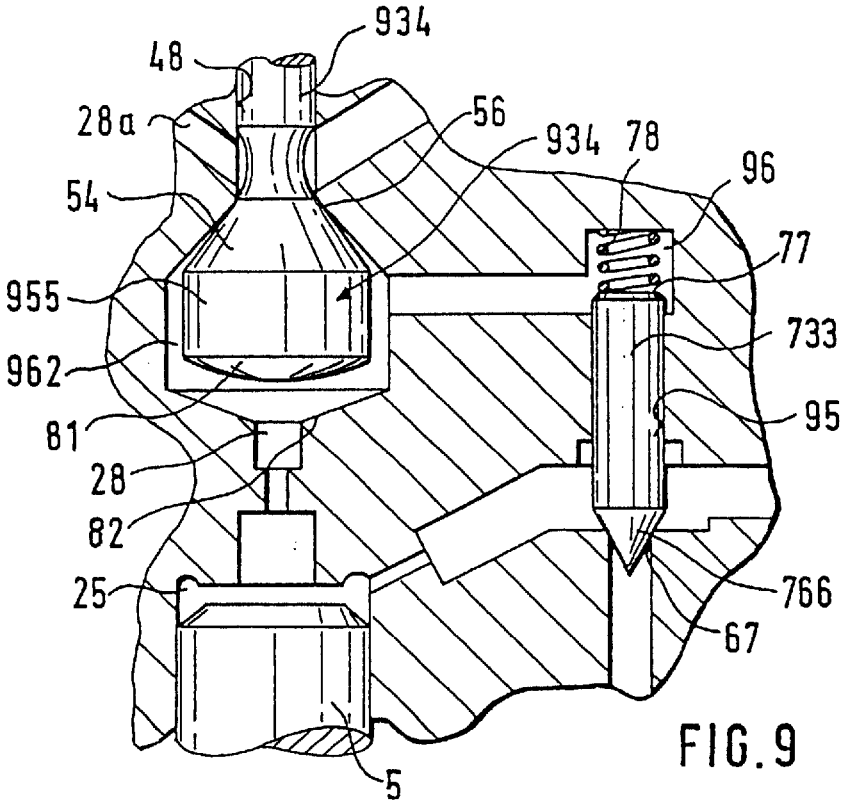
Figure 10:
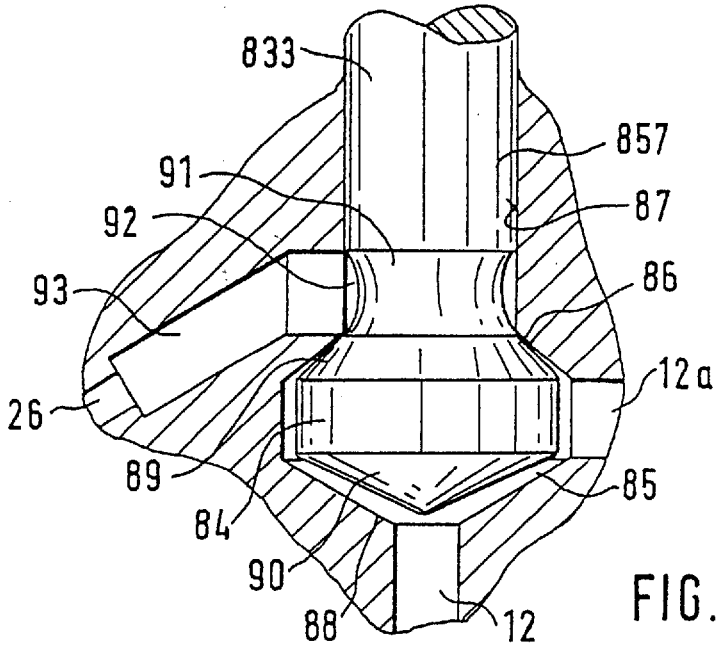

FIG. 3 shows a second exemplary embodiment of the control and actuation of the valves according to FIG. 1, FIG. 4 shows a third exemplary embodiment of the actuation and embodiment of the control valve and the safety valve in a modification in relation to FIG. 1, FIG. 5 shows a fourth exemplary embodiment of the actuation of the valve members of the safety valve and the control valve, FIG. 6 shows a fifth exemplary embodiment of an actuation of the control valve and the safety valve of the embodiment according to FIG. 5 in a modified form, FIG. 7 shows a sixth exemplary embodiment of the invention in a modified form of the embodiment of the safety valve and its control, FIG. 8 shows an alternative embodiment of the valve member of the control valve in a modification in relation to the embodiment according to FIG. 7, FIG. 9 shows another modification of the embodiment of the valve member of the control valve from FIG. 7, and FIG. 10 shows a modified embodiment of the valve member of the safety valve according to one of the preceding embodiments.

DESCRIPTION OF THE EXEMPLARY EMBODIMENT

FIG. 1 shows a simplified depiction of a fuel injection valve 1 which has an injection valve housing 2 with a bore 3 in which an injection valve member 5 is guided. On its one end, this injection valve member has a conical sealing face 6, which cooperates with a conical valve seat 7 at the end of the bore. Fuel injection openings 8 are disposed downstream of the valve seat 7, which are separated from a pressure chamber 9 when the sealing face 6 comes to rest on the valve seat. The pressure chamber 9 extends toward the valve seat 7 by way of an annular chamber 10 around the part 13 of the injection valve member that is provided with a smaller diameter and adjoins the sealing face 6 on the upstream side. By way of a pressure line 12, the pressure chamber 9 can be connected to a high-pressure fuel source in the form of a high-pressure fuel reservoir 14 that is supplied with fuel, which is from a tank 11 and has been brought to injection pressure, e.g. by a high-pressure pump 4 that feeds with a variable delivery rate. In the vicinity of the pressure chamber, the smaller diameter part 18 of the injection valve member, with a pressure shoulder 16 pointing toward the valve seat 7, transitions into a larger diameter part 18 of the injection valve member. This valve member is guided in a sealed fashion in the bore 3 and on the end remote from the pressure shoulder 16, continues on in a connecting piece 19 to a piston-shaped end 20 of the injection valve member. In the vicinity of the connecting piece, this valve member has a spring plate 22, and a compression spring 21, which impels the fuel injection valve member into the closed position, is clamped between this spring plate and the housing 1 of the fuel injection valve.

With an end face 24 whose area is greater than that of the pressure shoulder 16, the piston-like end 20 defines a control chamber 25 in the housing 2 of the fuel injection valve and this chamber: continuously communicates by way of a first throttle 26 with the high-pressure fuel reservoir 14 and communicates with a relief chamber 29 by way of a second throttle 27 disposed in an outflow conduit 28. The passage of the outflow conduit 28 is controlled by a control valve 31 with which the outflow conduit is either opened or closed.

The communication of the pressure chamber 9 with the high-pressure fuel reservoir 14 is controlled by a safety valve 32 whose valve member 33 and the valve member 34 of the control valve 31 are moved into an open or closed position by means of a common actuation device 36. The actuation device 36 is controlled in accordance with operation parameters by an electrical control device 37.

The control of the control valve 31 and the safety valve 32 serves to control the injection time and injection quantity of fuel into the combustion chambers of an associated engine, in particular a diesel internal combustion engine. Due to the continuous communication of the control chamber 25 with the high-pressure fuel reservoir 14, the high pressure prevailing there is at a high level when the control valve 31 is closed. When the safety valve is also closed, the communication is prevented between the high-pressure fuel reservoir 14 and the pressure chamber 9 so that even with a malfunction of the fuel injection valve, there is no high fuel pressure to produce a fuel injection when the injection valve member 18 is lifted. The balance of forces at the fuel injection valve 18 is such that when high fuel pressure prevails in the pressure chamber 9, the area of the pressure shoulder, which is smaller than the area of the end face 24, transmits a smaller force in the opening direction of the injection valve member than the pressure of the same level from the high-pressure fuel reservoir prevailing in the control chamber 25. In addition, the pre-stressed compression spring 21 acts in the closing direction so that the fuel injection valve is securely closed.

If, in order to trigger an injection, the valve member 34 of the control valve 31 is brought into an open position, then the control chamber 25 can be discharged to the relief chamber 29 so that uncoupled from the high-pressure fuel reservoir by the first throttle 26, a lower level pressure is automatically set in the control chamber 25. At the same time as the control valve 31, the safety valve is also opened so that the communication between the high-pressure fuel chamber 14 and the pressure chamber 9 is produced. Due to the currently different high pressures acting on the fuel injection valve member, the force in the opening direction resulting from the loading of the pressure shoulder 16 prevails. The fuel injection valve member is opened as a result and a fuel injection can take place through the injection openings 8. This takes place until the control valve 31 closes again and the relief of the control chamber 28 is prevented. As a result, the high pressure that prevails in the high-pressure fuel reservoir 14 can build up again spontaneously in the control chamber 25 by way of fuel supply via the first throttle 26 so that the balance of forces at the fuel injection valve member is greater in the closing direction and the fuel injection valve member is moved in the closing direction.

The safety valve 32 achieves the fact that in addition to controlling the fuel injection valve member 5 into an open position and a closed position, there is an additional control of the fuel supply from the high-pressure fuel reservoir 14 to the pressure chamber 9. This occurs synchronously to the control of the control valve 31. However, it is not necessary for the safety valve to be controlled with the same precision that is required with the control valve 31. This embodiment provides protection against the failure of such a fuel injection valve. If there should be a malfunction of the control valve 31 or if the function of the fuel injection valve should be impaired, then the fuel quantity supplied to the fuel injection valve can be limited with the aid of the safety valve so that even in the event of a failure of the above-mentioned members, an excessive fuel injection quantity is not delivered to the engine, which would otherwise cause the engine to race and be destroyed.

In the embodiment according to FIG. 1, both valves, the control valve 31 and the safety valve 32 are embodied as seat valves that are actuated in the same direction so that if the valve members 33 and 34 are moved downward in FIG. 1, a fuel injection is prevented, whereas if they are moved in the opposite direction, a fuel injection occurs. The control or the actuation of the valve members 33 and 34 by means of the actuation device 36 is not shown in detail in FIG. 1. The actuation device for the valve members can either have separate actuation mechanisms or can have a common actuation mechanism for both of the valve members. An embodiment of this kind is shown, for example, in FIG. 2. As a power generator for the actuation mechanisms, a piezoelectric actuation device 39 is provided in a particularly advantageous manner here in FIG. 2, which device acts on an actuation piston 40 and thereby can transmit a very high force to it in very short spans of time. On its end, the actuation piston defines a hydraulic chamber 42, which in turn is adjoined, coaxial to the actuation piston, by the end face of a transfer piston 43. The actuation piston, hydraulic chamber 42, and transfer piston 43 together constitute a hydraulic pressure intensifier, since with the aid of the different diameters of the two pistons 40 and 43, a force path transmission ratio can be set by way of the hydraulic chamber 42. The transfer piston 43 acts on a mechanical bridge 45, which jointly moves the valve members 33 and 34.

This apparatus can be produced with the control valve and the safety valve disposition shown in FIG. 1. With the exertion of force, i.e. with excitation of the piezoelectric actuation device 39, the valve members 33 and 34 are consequently held in the closed position so that the fuel injection pauses can be determined by means of the duration of the excitation of the piezoelectric actuation device. FIG. 3 shows an embodiment that is modified in relation to FIG. 2. In this instance, the mechanical bridge is eliminated. In lieu of this, a hydraulic pressure intensifier is produced here, which is comprised of a hydraulic chamber 42', which is defined on the one side by a movable wall, which is realized by the end face of the actuation piston 40, and is defined on the other side by movable walls that are constituted by the end face 46 of the valve member 34 of the control valve 31 and by the end face 47 of the valve member 33 of the safety valve 32. The movable walls mentioned above can naturally also act on the above-mentioned members 40, 33, and 43 indirectly. The actuation piston 40 in turn is moved by the piezoelectric actuation device 39. With the design of the end faces of the actuating piston 40 on the one hand and the design of the end faces of the valve members 33, 34 on the other, which define the hydraulic chamber 42', a hydraulic pressure intensifier is realized, which assures that at the same time and without tolerance and friction losses, the force of the piezoelectric actuation device 39 being triggered is transmitted to the valve members 33 and 34 by way of the actuation piston 40.

FIG. 4 shows a modification of the embodiment form of the valve members of the control valve 31 and the safety valve 32. Instead of the embodiment in FIG. 1, in which the valve members 33 and 34 each had a conical sealing face that cooperated with a correspondingly conical valve seat and were brought into the closed position with the exerted actuation force of the actuation device 39, in the embodiment according to FIG. 4, the valve members 33' and 34' are brought simultaneously into the open position upon actuation of the transfer piston 43. Analogous to the embodiment according to FIG. 2, in turn, the actuation piston 40 is provided, which, by way of the hydraulic chamber 42 acts on the transfer piston 43, which in turn moves the mechanical bridge 45 against which the valve member s 33' and 34' rest through the action of springs F that are not shown in detail here. When the actuation device is not excited, the spring $F_1$ moves the valve member 33' with a sealing face 52, which is attached to a closing body 51, into contact with a safety valve seat 50. At the same time, the valve member 34', is also held by just such a spring $F_2$ with a sealing face 54 on a closing body 55 in contact with a control valve seat 56. The closing body 51 of the valve member 33' is disposed on the end of a tappet 57, which is guided in a guide bore 58 and whose end opposite from the closing body 51 is brought into contact with the mechanical bridge 45 by means of spring force. Adjoining the sealing face 52, the tappet 57 has an annular groove 59, which in the closed position of the valve member 33' shown in FIG. 4, defines an annular chamber which communicates with the high-pressure fuel reservoir 14 by way of a part 12*a* of the pressure line 12 that feeds into the guide bore 58. The valve body 51 can be moved back and forth in a valve chamber 60 from which the pressure line 12 leads to the pressure chamber 9. In the position shown in FIG. 4, when the piezoelectric actuation device is not excited, the communication between the high-pressure fuel reservoir 14 and the pressure chamber 9 is consequently prevented. Independent of this, the high-pressure fuel chamber 14 communicates with the control chamber 25 via another line in an embodiment that is shown in FIG. 1. The valve member 34' of the control valve is embodied in the same manner as valve member 33'. Here, too, the valve body 55 can be moved in a valve chamber 62 and is fastened to the end of a tappet 63 guided in a guide bore 48. Between the sealing face 54, the adjacent part of the tappet 63, and the guide bore 48, an annular chamber 64 is also formed here, which continuously communicates with a part 28*a* of the outflow conduit 28. The outflow conduit 28 feeds into the valve chamber 62 from the control chamber 25. When the valve member 34 is open, this outflow conduit communicates with the part 28*a,* which leads on to the relief chamber 29.

With the arrangement of valves shown here, the piezoelectric actuation device 39 is only respectively excited as long as an injection is intended to take place. The transfer piston 43 moves the mechanical bridge 45 and at the same time moves the valve members 33' and 34' so that both valves, the control valve 31 and the safety valve 32, are opened and the injection can take place as has already been described above. Instead of the mechanical bridge 45 used here, naturally the hydraulic chamber can also be embodied analogously to the embodiment of FIG. 3. This has advantages with regard to the transmission forces, which in the form of the hydraulic pressure intensifier, can be individually adjusted in accordance with each valve member with regard to the simultaneous actuation and freedom from friction. On the other hand, a sufficient filling of the hydraulic chamber must always be provided for.

However, the valve springs of the control valve 31 and the safety valve 32 can also be differently embodied, as can be inferred from FIG. 5, and thereby the valve member 534 can, for example, be embodied in the same manner as the valve member 34', the valve member 533, on the other hand, must be embodied in the same way as the valve member 33 of FIG. 1. This valve member 533 then has a conical sealing face 66 at the end of the valve member, which cooperates with a valve seat 67 that adjoins the entry into the pressure line 12 leading to the pressure chamber 9. On the other side of the valve seat, the part 12*a* of the pressure line leading to the high-pressure fuel reservoir 14 feeds into a valve chamber 68 into which the end of the valve member 533 protrudes. On the other end of the valve member, which is in turn guided in a guide bore 558, it rests with its end face 69 against a balance arm 70 which can be pivoted around a fixed axis 71 and whose other lever arm rests against the end of the valve member 534 and on the opposite side from this valve member, rests against the transfer piston 43, which is adjoined—as in FIG. 4—by the hydraulic chamber 42, the actuation piston 40, and the piezoelectric actuation device 39. If the latter is excited, then the transfer piston 43 moves the balance arm 70 in such a way that the valve member 543 is moved into an open position counter to the force of the spring F and at the same time the valve member 533 is likewise moved into an open position through the action of the spring $F_1$, following the balance arm 70. When the piezoelectric actuation device 39 is not excited, the spring $F_1$, which is disposed against the valve member 534, moves it into a closed position and at the same time, by means of the balance arm 70, likewise moves the valve member 533 into the closed position counter to the force of the spring $F_2$. This requires a careful matching of the spring forces and actuation forces. In a fifth exemplary embodiment according to FIG. 6, instead of the mechanically acting balance arm 70, a hydraulic chamber 642 is in turn provided, which is defined on the one side by the tappet 663 of the valve member 634 and is defined on the other side by the transfer piston 43. For the actuation of the valve member 633 that is embodied analogously to the one in FIG. 5, it has a connecting piece on its one end in the form of a coupling pin 72, which sticks into the hydraulic chamber 642 and on its end is connected to an actuating piston 73, which is guided in the housing of the fuel injection valve and with its end face 74 constitutes a movable wall that is acted on by pressure, and when this wall moves, the valve member 633 is also moved. On its rear end, the actuating piston adjoins a chamber 49 that is pressure relieved. At the transition between the coupling pin 72 and the valve member 633, a relief chamber 75 is provided, by way of which a leakage quantity can be drained and which supplies the necessary actuation space for the valve member 633. This valve member is loaded in the closing direction by a spring $F_2$, which holds the valve member 633 with its sealing face 66 against the valve seat 67 when the hydraulic chamber 642 is not loaded. If the transfer piston 43 is moved upon excitation of the piezoelectric actuation device 39, then the pressure in the hydraulic chamber 642 increases, which results in a movement of the valve member 663 in the opening direction counter to the force of the spring $F_2$, by means of the actuating piston 73 which is acted on by pressure. At the same time, the increased pressure in the hydraulic chamber 642 produces a movement of the tappet 663 and consequently an opening of the control valve. The valve member 634 is embodied the same as the corresponding valve member 43' in FIG. 4, but with the difference that the drive here takes place directly in a hydraulic fashion by way of the hydraulic chamber 692 and counter to the closing force of the spring $F_1$.

It must be inferred from FIG. 6 that the valve chamber 68 on the one side continuously communicates with the high-pressure fuel reservoir by way of the part 12*a* of the pressure line and that from the valve chamber 68, the pressure line 12 leads to the pressure chamber 9 by way of the valve seat 67. Furthermore, the valve chamber 68 continuously communicates with the control chamber 25 by way of the first throttle 26. The control chamber in turn analogously communicates with the valve chamber 62 of the control valve by way of the second throttle 27 in the outflow conduit 28 and when the valve member 634 is moved into the open position, can communicate with the continuing part 28*a*. In this exemplary embodiment as well, a control for actuating the piezoelectric actuation device 39 only occurs at those times in which a fuel injection is intended to take place.

In a sixth exemplary embodiment according to FIG. 7, the control valve has a valve member 734 that is embodied in the same manner as the valve member 634, 534, or 34'. One of the drive mechanisms provided in FIGS. 4 to 6 can be used for driving purposes. In contrast to the preceding exemplary embodiments, now a safety valve is provided with a valve member 733, which first of all, has a conical sealing face 766, in a manner analogous to FIG. 6, on the end of a tappet 757 of the valve member 733, which tappet is guided in a sealed fashion in a guide bore 95 in the injection valve housing 2 and protrudes into the valve chamber 768. The sealing seat 766 cooperates with the conical valve seat 67, in the same manner as in FIG. 6. With a part of the sealing face 766 not covered by the valve seat 67, this sealing face simultaneously constitutes a first pressure face against which the pressure in the valve chamber 768 acts in the opening direction on the valve member 733 when the safety valve is closed. The valve chamber 768 in turn continuously communicates with the high-pressure fuel reservoir by way of the pressure line part 12*a* and continuously communicates with the control chamber 25 by way of the throttle 26. From the valve seat 67, the pressure line 12 leads on to the pressure chamber 9.

In contrast, now the rear end face 77 of the tappet 757, as a second pressure face of the valve member 733, adjoins a safety valve pressure chamber 96, which communicates with the valve chamber 762 and is subjected to the pressure of the valve chamber 762, which is also the pressure in the control chamber 25, since the two chambers continuously communicate with each other by way of the second throttle 27. In addition, a compression spring 78 acts on the end face 77 and loads the valve member 733 in the closing direction. In this exemplary embodiment, if the valve member 734 of the control valve 31 is in the closed position depicted, then the high fuel pressure of the high-pressure fuel reservoir that has been supplied by way of the throttle 26 has been automatically set in the control chamber 25. In addition, this pressure also acts on the end face 77 of the valve member 733 of the safety valve and holds the valve member 733 in the closed position. If the control valve is now opened and the control chamber 25 is relieved, then the end face 77 is also relieved. At the same time, however, the pressure that continues to be high in the valve chamber 768 then acts on the conical sealing face 766, which adjoins the valve seat 67 on the control chamber side, and overcomes the resultant force, the closing force of the spring 68, and brings the valve member 733 into the open position. Consequently, fuel can then be supplied to the pressure chamber 9 and the injection can take place if at the same time, through the action of the high pressure on the pressure shoulder 16, the fuel injection valve member 5 is moved in the opening direction when the control chamber pressure in the control chamber 25 is reduced. In this exemplary embodiment, the safety valve is automatically switched in an advantageous manner, without a special actuation device. The safety valve always opens whenever the required low pressure prevails in the control chamber 25 and a sufficiently high pressure is available for the injection. This can consequently be realized even if, instead of controlling the control chamber pressure by way of the 2/2-way control valve, the control is executed by means of a 3/2-way valve in a relief line and a throttle high-pressure connection to the control chamber, and this 3/2-way valve connects the control chamber either to the high-pressure reservoir 14 or to the relief chamber 29.

In lieu of the valve member 733 from FIG. 7, a seat valve can also be realized, as can be inferred from FIG. 8. The valve member has a ball 79 which cooperates with a conical seat 80 at the mouth of the outflow conduit 28 into the valve chamber 862. One of the preceding means, FIGS. 2 to 6, can be used as a drive mechanism.

In an improved eighth embodiment of the invention according to FIG. 9, the valve member 733 of the safety valve is in turn provided in the same embodiment as in FIGS. 4 to 7. The valve member 733 thus has a valve body 955 with a sealing face 54, which cooperates with the valve seat 56. In contrast to the embodiment according to FIGS. 4 to 7, a second sealing face 81 is provided on the valve body 955 on the side opposite from the sealing face 54 and cooperates with a second valve seat 82. This second valve seat 82 adjoins the infeed of the outflow conduit 28 into the valve chamber 962. When the piezoelectric actuation device actuates the valve member 934, it lifts with its sealing face 54 up from the valve seat 56 and consequently produces the connection between the outflow conduit 28 and the outflow conduit part 28*a* by way of the valve chamber 962, as is the case in the previous exemplary embodiments according to FIGS. 4 to 7. The valve member 934, however, moves further through the action of the piezoelectric actuation device until it comes into contact with the sealing face 81 against the second valve seat 82 and therefore in turn, closes the outflow conduit 28. As a result, the high pressure can build up again in the control chamber 25, which moves the fuel injection valve member 5 in the closing direction. The valve member 733 is now once more relieved on its end face 77 since the valve chamber 962 communicates with the outflow conduit part 28*a* by way of the valve seat 56 that is now open. The valve member 733 thus continues to remain in the open position until the valve member 934 of the control valve travels back in the closing direction. With the momentary production of the connection between the outflow conduit 28 and the outflow conduit 28*a,* and with the subsequent relief of the control chamber 25, a short fuel injection is realized, which is usually a pre-injection quantity that must afterward be followed by a main injection. For this purpose, the piezoelectric actuation device can sometimes be de-energized so that the valve body 955 remains in an intermediary position in the valve chamber 962 in which both of the valve seats 56 and 82 are open and consequently, the control chamber 25 is relieved. The valve member 733 is then once more in the open position since the end face 77 is also relieved. To end the main fuel injection, the valve member 934 is brought back against the valve seat 56. A high pressure can then build up again in the control chamber 25, which also propagates into the valve chamber 962 and acts on the end face 77 of the valve member 733 of the safety valve and moves this into the closed position. With this embodiment, a pre-injection and a main injection can be realized with extremely short fuel injection times, which are defined by the movement of the valve member 934 of the control valve from the first valve seat 56 to the second valve seat 82. In order not to interfere with the entire injection, in the device disclosed here, the valve member 733 is open during the pre-injection, the injection pause following it, and the subsequent main injection. Only after this is it closed so that when there is high pressure in the control chamber 25, it is assured that no more fuel can flow into the pressure chamber 9 and cause an unwanted fuel injection there. But if instead of communicating with the valve chamber 962, the end face 77 now communicates directly with the control chamber 25, then the safety valve is also closed once more in the injection pauses.

FIG. 10 shows a last exemplary embodiment with a modified form of the safety valve. In this instance, the safety valve 833 is embodied as a 3/2-way valve. With an actuation analogous to the preceding exemplary embodiments, the safety valve member 833 in turn has a tappet 857, which is guided in a bore of the fuel injection valve housing and ends in a valve head 84. This head can be moved in a valve chamber 85, which continuously communicates with the high-pressure fuel reservoir 14. On the one side, the valve chamber 85 is defined by a first valve seat 86 at the transition to the bore 87 guiding the tappet 57 and, opposite from this valve seat, the valve chamber is defined by a second valve seat 88, which is formed at the outgoing pressure line 12. The valve head has a first, for example conical sealing face 89, which cooperates with the first valve seat 86, and on the side opposite from this first sealing face 89, has a second conical sealing face 90, which cooperates with the second valve seat 88. An annular groove 91 is let into the transition between the first sealing face 59 and the guided part of the tappet 857 and, together with the wall of the bore 87, constitutes an annular chamber 92, which in turn communicates with the control chamber 25 by way of a pressure line 93 in which the first throttle 26 is disposed. With a safety valve 833 that is equipped in this manner, at times in which fuel is intended to be injected, the communication from the high-pressure fuel reservoir 14 to the control chamber 25, which has been relieved by the control valve, can be interrupted at the same time. The communication from the high-pressure fuel reservoir 14 to the pressure chamber 9 is produced at the same time. This leads to a particularly effective relief of the control chamber 25 and to a high force development in the opening direction since in the case of the desired opening of the fuel injection valve 5, no more fuel subsequently flows into the control chamber 25 by way of the throttle 26 and can consequently influence the pressure level. If the fuel injection is to be ended, the valve member 833 is also brought into a second closed position in which it thereby closes the pressure line 29 with the second sealing face 90 and at the same time produces the communication between the control chamber 25 and the high-pressure fuel reservoir 14 by way of the first valve seat 86. The desired high pressure can then build up in the control chamber 25 which brings the fuel injection valve member 5 into the closed position. If this safety valve member 833, by means of a corresponding drive mechanism, is brought with its valve head 84 into an intermediary position, then the control chamber 25 is brought to a pressure level that lies between the maximum pressure and the completely relieved pressure. This middle pressure brings about a reduced opening of the fuel injection valve member 12 in such a way that for a short time, a small fuel injection quantity can be introduced for the purpose of a pre-injection. It is thereby possible, by opening the fuel injection valve slightly, to also shape the fuel injection stream with a throttling of the fuel supply to the fuel injection openings.

The safety valve embodied according to FIG. 10 can be actuated by means of a separate piezoelectric actuation device and by means of a jointly transmitted actuation device which also controls the valve member of the control valve. In order to assume the above-mentioned intermediary position between the first valve seat 86 and the second valve seat 88, however, a separate control by means of a piezoelectric actuation device which is associated with the safety valve is required, which can also execute partial adjustment paths with corresponding excitation. The control valve, however, can also be actuated in this instance by means of an electromagnet.

Fundamentally, in the preceding embodiments of FIGS. 1 to 8, an actuation of the valve members by means of electromagnets is possible even though these are influenced in terms of switching speed by means of the electromagnetic hysteresis. Instead of controlling the pressure in the control chamber 25 with the aid of a 2/2-way valve, which is partially demonstrated here, a control of this kind is also possible by means of a 3/2-way valve and the safety valve according to the invention can be used at the same time. In a first position of the valve member, a 3/2-way valve of this kind has connected the control pressure chamber 29 to the high-pressure fuel reservoir and in a second position, it has connected the control chamber 25 to the relief chamber 29. At the same time, with the switching into the first position of the 3/2-way valve, in one such case, the valve member of the safety valve is also brought into the closed position. If in the other switched position of the 3/2-way valve, the control chamber 25 is then connected to the relief chamber, then the safety valve is also simultaneously opened. A 3/2-way valve of this kind can thereby be realized in a manner analogous to the embodiment of the valve member 833 of FIG. 10.

The foregoing relates to preferred exemplary embodiments of the invention, it being understood that other variants and embodiments thereof are possible within the spirit and scope of the invention, the latter being defined by the appended claims.

What is claimed is:

1. A fuel injection valve for internal combustion engines, comprising a high-pressure fuel reservoir (14) supplied by a high-pressure pump, said reservoir is respectively connected by way of a pressure line (12) to a pressure chamber (9) of a fuel injection valve (1), said fuel injection valve (1) has a fuel injection valve member (5), which, by way of a pressure shoulder (16), is acted on in an opening direction counter to a closing force by a pressure in the pressure chamber (9) and, at least indirectly, by a pressure prevailing in a control chamber (25), said control chamber acts in the closing direction on a movable wall (24) that defines the control chamber (25) and is connected to the fuel injection valve member, wherein the force resulting from a first pressure in the control chamber (25) produces a closing force that is greater than the opening force acting in the opening direction by way of the pressure shoulder (16), and with an electrically controlled control valve (31) by means of which, in order to initiate the fuel injection, a relief conduit (28) that connects the control chamber (25) to a relief chamber (29) is opened in order to relieve the pressure in the control chamber to a second relief pressure, which results in a closing force that is less than the opening force, a controlled safety valve (32) is disposed in the pressure line (12), by means of which a connection from the high-pressure fuel reservoir (14) to the pressure chamber (9) is open during those times in which a fuel injection is intended to be carried out and is closed between the individual injection cycles, in which the safety valve (32) and the control valve (31) are actuated simultaneously by means of an electrically controlled actuation mechanism (36, 39).

2. The fuel injection valve according to claim 1, in which the control valve is embodied as a 3/2-way valve which connects the control chamber (25) either to the high-pressure fuel reservoir (14) or to the relief chamber (29).

3. The fuel injection valve according to claim 1, in which by way of a first throttle (26), the control chamber (25) continuously communicates with the high-pressure fuel reservoir (14) and, by means of the control valve (31) embodied as a 2/2-way valve, is connected to the relief chamber (29) by way of a cross section that is greater than the cross section of the first throttle (26).

4. The fuel injection valve according to claim 2, in which the safety valve (32) is actuated by means of an electrically controlled actuation mechanism (36, 39).

5. The fuel injection valve according to claim 1, in which the control valve (31) and the safety valve (32) are actuated jointly by means of a single actuation mechanism (39).

6. The fuel injection valve according to claim 1, in which a hydraulic pressure intensifier (40, 42, 43; 40, 42', 33, 34, 73) is used to transmit the actuation force of the actuation mechanism.

7. The fuel injection valve according to claim 6, in which a hydraulic chamber (42) is enclosed between the actuation mechanism (39) and the valve members (33, 34) of the safety valve (32) and the control valve (31) and, in order to transmit the actuation movement of the actuation mechanism (39), a piston (43) is provided, which adjoins the hydraulic chamber (42) and acts on a mechanical bridge (45) against which the valve members (33, 34) rest.

8. The fuel injection valve according to claim 6, in which the hydraulic pressure intensifier is comprised of a hydraulic chamber (42') which is enclosed on one side by a wall (40) that is moved by the actuation mechanism and is enclosed on another side by movable walls that are connected to the valve members (33, 34) of the control valve (31) and the safety valve (32).

9. The fuel injection valve according to claim 1, in which the control valve (31) and the safety valve (32) are embodied so that their valve members (33 and 34) are held in the closed position by means of a restoring force ($F_1$, $F_2$) when the actuation mechanism (39) is not activated and is brought into the open position by the actuating force of the actuation mechanism (39).

10. The fuel injection valve according to claim 1, in which the control valve (31) and the safety valve (32) are embodied so that their valve members (33, 34) are held in the open position by means of a restoring force when the actuation mechanism (39) is not activated and is brought into the closed position by the actuating force of the actuation mechanism.

11. The fuel injection valve according to claim 1, in which the safety valve (32) has a valve member (34) that is guided in a guide bore (95), has a sealing face (766) on one end that protrudes from the guide bore (95), said sealing face cooperates with a valve set (67), and has a first pressure face (766) that is continuously subjected to the pressure of the high-pressure fuel reservoir (14), and has a second pressure face (77) on another end that protrudes from the guide bore (95), which pressure face is subjected to the pressure in the control chamber (25), and is additionally acted on in the closing direction toward the valve seat (67) by a spring (78), wherein the force resulting from the loading of the pressure of the high-pressure fuel reservoir (14) is greater than the force of the spring (78) acting in the closing direction, together with the pressure that prevails in the control chamber (25) when it is relieved.

12. The fuel injection valve according to claim 4, in which the safety valve (32) has a valve member (34) that is guided in a guide bore (95), has a sealing face (766) on one end that protrudes from the guide bore (95), said sealing face cooperates with a valve set (67), and has a first pressure face (766) that is continuously subjected to the pressure of the high-pressure fuel reservoir (14), and has a second pressure face (77) on another end that protrudes from the guide bore (95), which pressure face is subjected to the pressure in the control chamber (25), and is additionally acted on in the closing direction toward the valve seat (67) by a spring (78), wherein the force resulting from the loading of the pressure of the high-pressure fuel reservoir (14) is greater than the force of the spring (78) acting in the closing direction, together with the pressure that prevails in the control chamber (25) when it is relieved.

13. The fuel injection valve according to claim 7, in which the safety valve (32) has a valve member (34) that is guided in a guide bore (95), has a sealing face (766) on one end that protrudes from the guide bore (95), said sealing face cooperates with a valve set (67), and has a first pressure face (766) that is continuously subjected to the pressure of the high-pressure fuel reservoir (14), and has a second pressure face (77) on another end that protrudes from the guide bore (95), which pressure face is subjected to the pressure in the control chamber (25), and is additionally acted on in the closing direction toward the valve seat (67) by a spring (78), wherein the force resulting from the loading of the pressure of the high-pressure fuel reservoir (14) is greater than the force of the spring (78) acting in the closing direction, together with the pressure that prevails in the control chamber (25) when it is relieved.

14. The fuel injection valve according to claim 11, in which a safety valve pressure chamber (96) that is adjoined by the second pressure face (77) of the safety valve member (733) communicates with the control chamber (25) by way of the valve chamber (762).

15. The fuel injection valve according to claim 11, in which the control valve (31) has a control valve member (34', 534, 734, 934), which has a tappet (63) guided in a guide bore (48), on whose end protruding into a valve chamber (62) connected to the control chamber (25) a valve body (55) is disposed, which, on an end of the tappet (63), has a sealing face (54) which cooperates with a valve seat (56) between the guide bore (48) and the valve chamber (62).

16. The fuel injection valve according to claim 15, in which another end of the tappet (63, 663) of the control valve member (34) protrudes into the hydraulic chamber (42', 642), which is defined on another end by the movable wall (40) that is connected to the actuation mechanism (39) and by a movable wall (47, 74) that is connected to the closing member (33, 633) of the safety valve (32).

17. The fuel injection valve according to claim 16, in which the movable wall (47, 74) that acts on the closing member (33, 633) of the safety valve (32) and the movable wall (46) that acts on the tappet (33, 633) of the control valve member (34, 634) are acted on in the opening direction of the valves by the pressure in the hydraulic chamber (42', 642) when there is a pressure increase.

18. The fuel injection valve according to claim 17, in which the hydraulic chamber (642) is disposed lateral to the axis of the tappet (633) of the valve member (634) of the control valve (31) and of the actuation mechanism (39, 40) and the movable wall (74) that acts on the closing member (633) of the safety valve (32) is embodied on an actuating piston (73) that is affixed to one end of a connecting piece (72) which is guided through the hydraulic chamber (642) and on another end, is connected to the valve member (633).

19. The fuel injection valve according to claim 18, in which on its end remote from the hydraulic chamber (642), the actuating piston (73) is connected to a chamber (49) that is pressure relieved.

20. The fuel injection valve according to claim 8, in which an end of the control valve member (534) rests against a first lever arm of a transfer lever (70), which is pivoted around a fixed axis and whose second lever arm contacts an end of the safety valve (533), and the actuation mechanism (39, 40, 42, 43) comes into at least indirect contact with the transfer lever (70) in order to actuate the valves in the closing direction or the opening direction.

21. The fuel injection valve according to claim 20, in which the control valve member (534) and the safety valve closing member (533) come into contact with the same side of the transfer lever (70) and the actuation mechanism (39, 40, 42, 43) at least indirectly engages on the side disposed opposite from them.

22. The fuel injection valve according to claim 15, in which on the side remote from the guide bore (48), a second sealing face (81) is disposed on the valve body (955) and a second valve seat (82) is embodied at the connection from the valve chamber (962) to the control chamber (25), said second valve seat is disposed opposite the first valve seat (56) in the axial direction of the control valve (31) and cooperates with the second sealing face (81), wherein with an actuation of the valve member (934) of the control valve in the opening direction in order to relieve the control chamber (25), the valve body (955) lifts with its first sealing face (54) up from the first valve seat (56) and after a momentary opening of the control chamber (25), via the connection of the relief conduit (28) that is opened up by means of the two valve seats (56, 82), comes back into contact with its second sealing face (81) against the second valve seat (82).

23. The fuel injection valve according to claim 3, in which the safety valve (32) is embodied as a 3/2-way valve, with a valve closing member (833) that is actuated by an electric actuation mechanism and has a valve head (84) which, with a first sealing face (90) controls the communication between the high-pressure fuel reservoir (14) and the pressure chamber (9) of the fuel injection valve and with the other sealing face (89), in its other position, controls the opening of a connecting line (93) between the high-pressure fuel reservoir (14) and the control chamber (25) in which connecting line (93) the first throttle (26) is disposed, whose cross section is smaller than the cross section of the second throttle (27) disposed in the relief line (28) of the control chamber (25).

24. The fuel injection valve according to claim 1, in which a piezoelectric actuation device is provided as the actuation mechanism.

25. The fuel injection valve according to claim 1, in which a magnet coil is provided as an actuation mechanism.

26. The fuel injection valve according to claim 24, in which the safty valve (32) and the control valve (31) are both actuated by a common actuator.

* * * * *